US012467623B2

(12) United States Patent
Wu

(10) Patent No.: US 12,467,623 B2
(45) Date of Patent: Nov. 11, 2025

(54) COMBUSTION DEVICE ALLOWING FOR AN EASY WICK INSTALLATION

(71) Applicant: Pro-Iroda Industries, Inc., Taichung (TW)

(72) Inventor: Wei Cheng Wu, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 454 days.

(21) Appl. No.: 18/084,831

(22) Filed: Dec. 20, 2022

(65) Prior Publication Data

US 2024/0102647 A1 Mar. 28, 2024

(30) Foreign Application Priority Data

Sep. 27, 2022 (TW) ..... 111136492

(51) Int. Cl.
*F23D 3/24* (2006.01)

(52) U.S. Cl.
CPC ..... *F23D 3/24* (2013.01)

(58) Field of Classification Search
CPC ..... F23D 3/24; F23D 2202/00; F21V 37/002
USPC ..... D26/116
See application file for complete search history.

(56) References Cited

U.S. PATENT DOCUMENTS

| | | | | | |
|---|---|---|---|---|---|
| 73,488 | A * | 1/1868 | Atwood | F23D 3/00 | 431/314 |
| 87,898 | A * | 3/1869 | Alexander | F21V 17/00 | 362/314 |
| 98,836 | A * | 1/1870 | Atwood | F23D 3/00 | 431/314 |
| RE7,278 | E * | 8/1876 | Atwood | 431/314 | |
| 664,167 | A * | 12/1900 | Moegling | F23D 3/24 | 431/291 |
| 1,341,494 | A * | 5/1920 | Closs | F23D 3/00 | 431/309 |
| 4,544,351 | A * | 10/1985 | Marsicano | F21V 35/00 | 362/163 |
| D541,443 | S * | 4/2007 | Adams | D26/9 | |
| 9,109,797 | B2 | 8/2015 | Chen | | |
| 9,428,713 | B2 * | 8/2016 | Tyson | C11C 5/006 | |
| 11,603,990 | B2 | 3/2023 | Wu | | |
| 2007/0006521 | A1 * | 1/2007 | Licciardello | C11C 5/008 | 44/275 |
| 2007/0248922 | A1 * | 10/2007 | Mahdavieh | F23D 3/16 | 431/291 |

(Continued)

FOREIGN PATENT DOCUMENTS

| | | | |
|---|---|---|---|
| DE | 202015002111 U1 | | 6/2016 |
| GB | 190716515 A | * | 3/1908 |
| TW | I704317 B | | 9/2020 |

*Primary Examiner* — Jorge A Pereiro
(74) *Attorney, Agent, or Firm* — MUNCY, GEISSLER, OLDS & LOWE, P.C.

(57) ABSTRACT

A combustion device allowing for an easy wick installation includes a container having a space forming a fuel tank, a wick holder mounted in the container, and a wick insertably mounted on the wick holder. The wick holder, along an outer peripheral edge thereof, has a resilient structure and defines an elastic portion. The elastic portion is resiliently deformable and abuts against an inner peripheral edge of the container, thereby fitting in the container. The wick has a first end inserted into the fuel tank and a second end protruding on a side of the wick holder opposite to the fuel tank.

11 Claims, 4 Drawing Sheets

(56) References Cited

U.S. PATENT DOCUMENTS

| | | | | |
|---|---|---|---|---|
| 2014/0087318 | A1 | 3/2014 | Chen | |
| 2017/0059155 | A1* | 3/2017 | Fendler | F23D 3/18 |
| 2019/0101281 | A1* | 4/2019 | Chen | F23D 3/18 |
| 2021/0048190 | A1* | 2/2021 | Wu | F23D 3/24 |

* cited by examiner

COMBUSTION DEVICE ALLOWING FOR AN EASY WICK INSTALLATION

BACKGROUND OF THE INVENTION

1. Field of the Invention

The present invention relates to a combustion device and, particularly, to a combustion device allowing for an easy wick installation.

2. Description of the Related Art

TW Patent No. 1704317, entitled a burner with a fixing assembly, discloses a burner including a container, a fixing assembly, and a wick. The container has an opening and an inner space thereof forming an accommodating portion. The fixing assembly, which is used to hold the wick, is inserted into the container through the opening and arranged in the accommodating portion. The fixing assembly includes a fixing member, an oil pan, and a cover. The fixing member is elastically deformable between an expanded position and a compressed position and adapted to abut against the periphery of the inner space. The oil pan is disposed on the fixing member. The oil pan is covered by the cover. The fixing member, in the expanded position, has a width greater than the width of the opening. Moreover, the fixing member, in the compressed position, has a width less than the width of the opening and therefore, it can be inserted through the opening and mounted in the container. It, however, takes time and effort for a user to assemble the fixing assembly.

The present invention is, therefore, intended to obviate or at least alleviate the problems encountered in the prior art.

SUMMARY OF THE INVENTION

According to the present invention, a combustion device allowing for an easy wick installation includes a container having a space forming a fuel tank, a wick holder mounted in the container, and a wick insertably mounted on the wick holder. The wick holder, along an outer peripheral edge thereof, has a resilient structure and defines an elastic portion. The elastic portion is resiliently deformable and abuts against an inner peripheral edge of the container, thereby fitting in the container. The wick has a first end inserted into the fuel tank and a second end protruding on a side of the wick holder opposite to the fuel tank.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the abstract is to enable the public generally, and especially scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
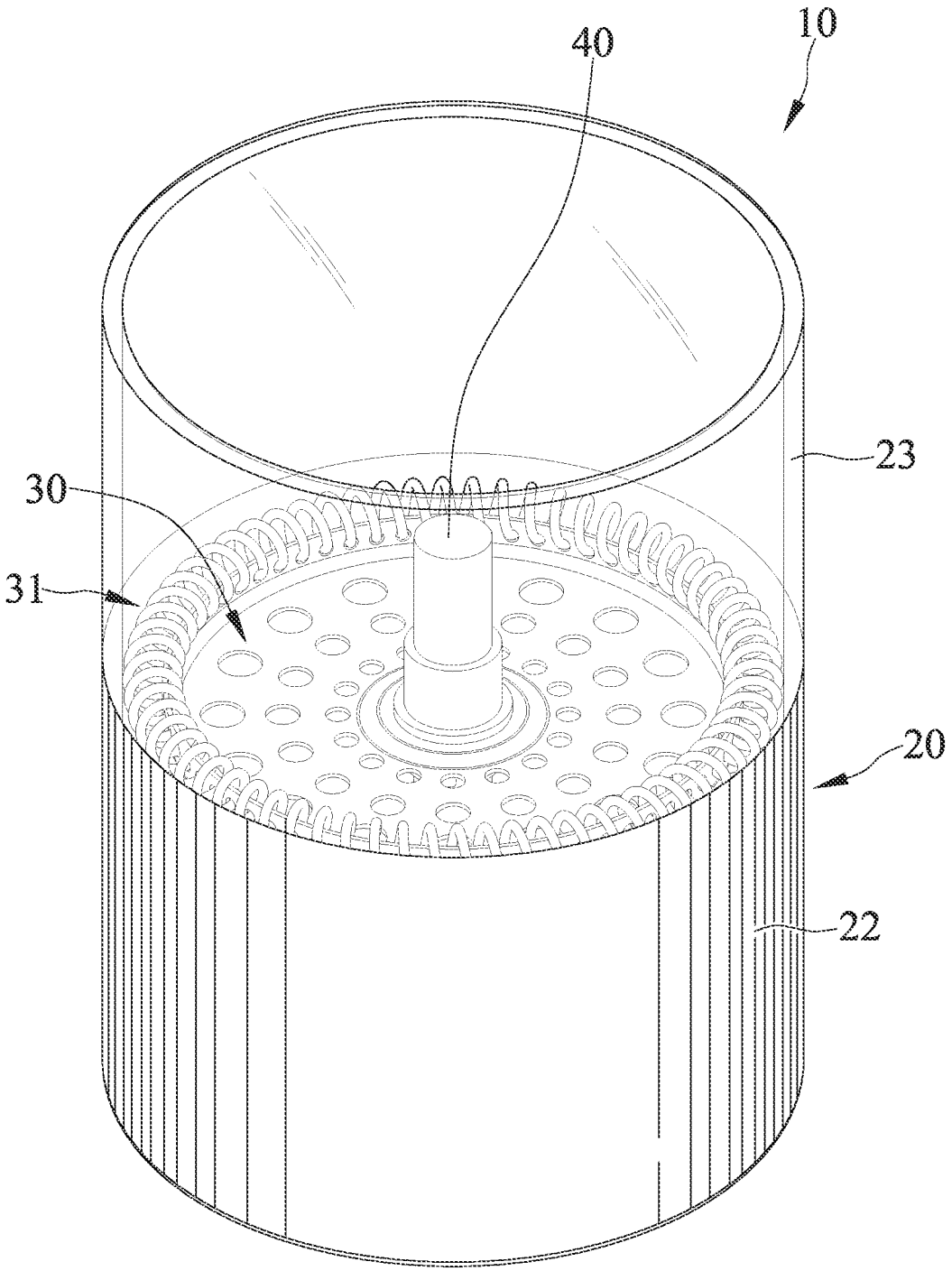
FIG. 1 is a perspective view of a combustion device allowing for an easy wick installation in accordance with the present invention.
Figure 2:
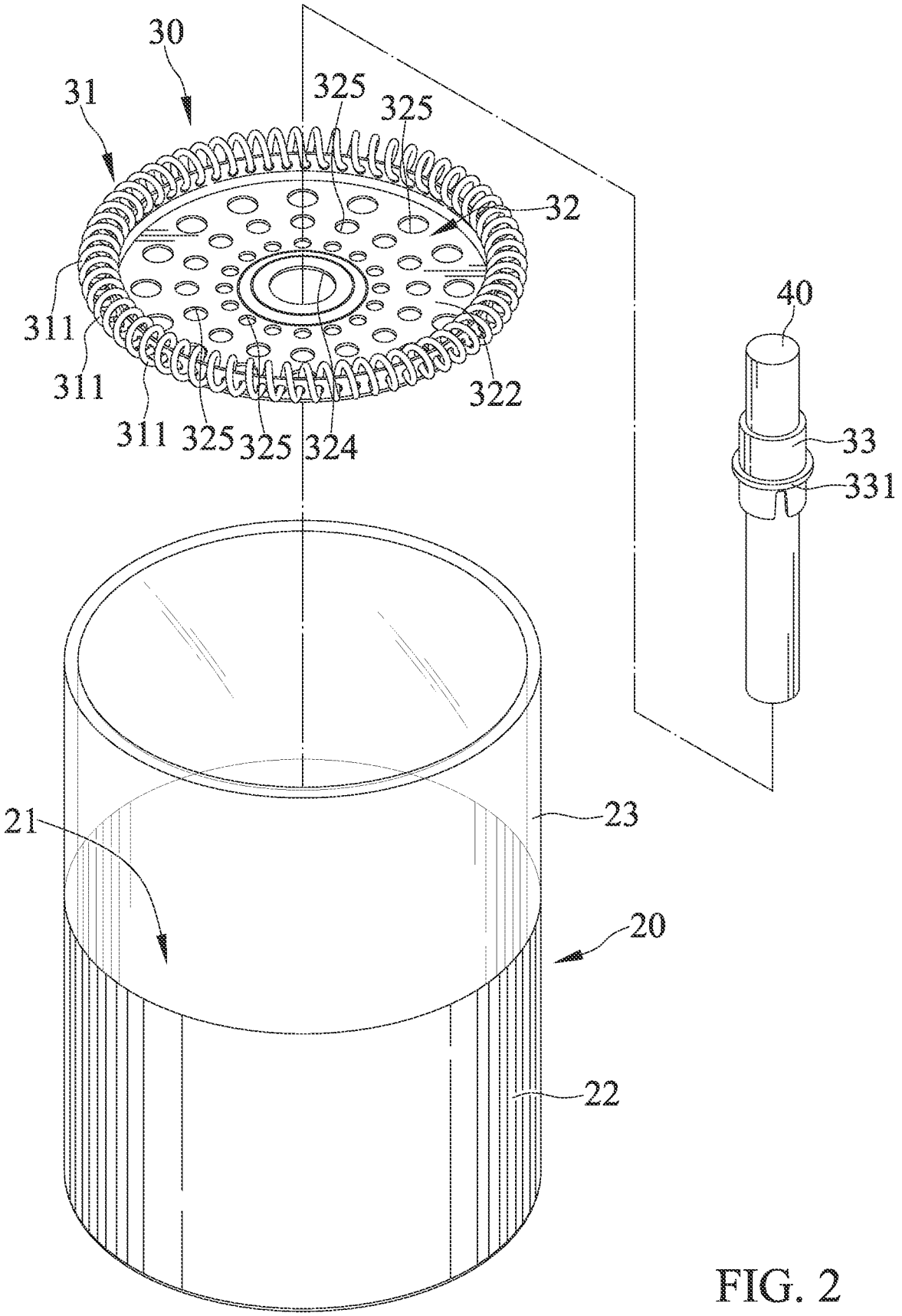
FIG. 2 is an exploded perspective view of the combustion device of FIG. 1.
Figure 3:
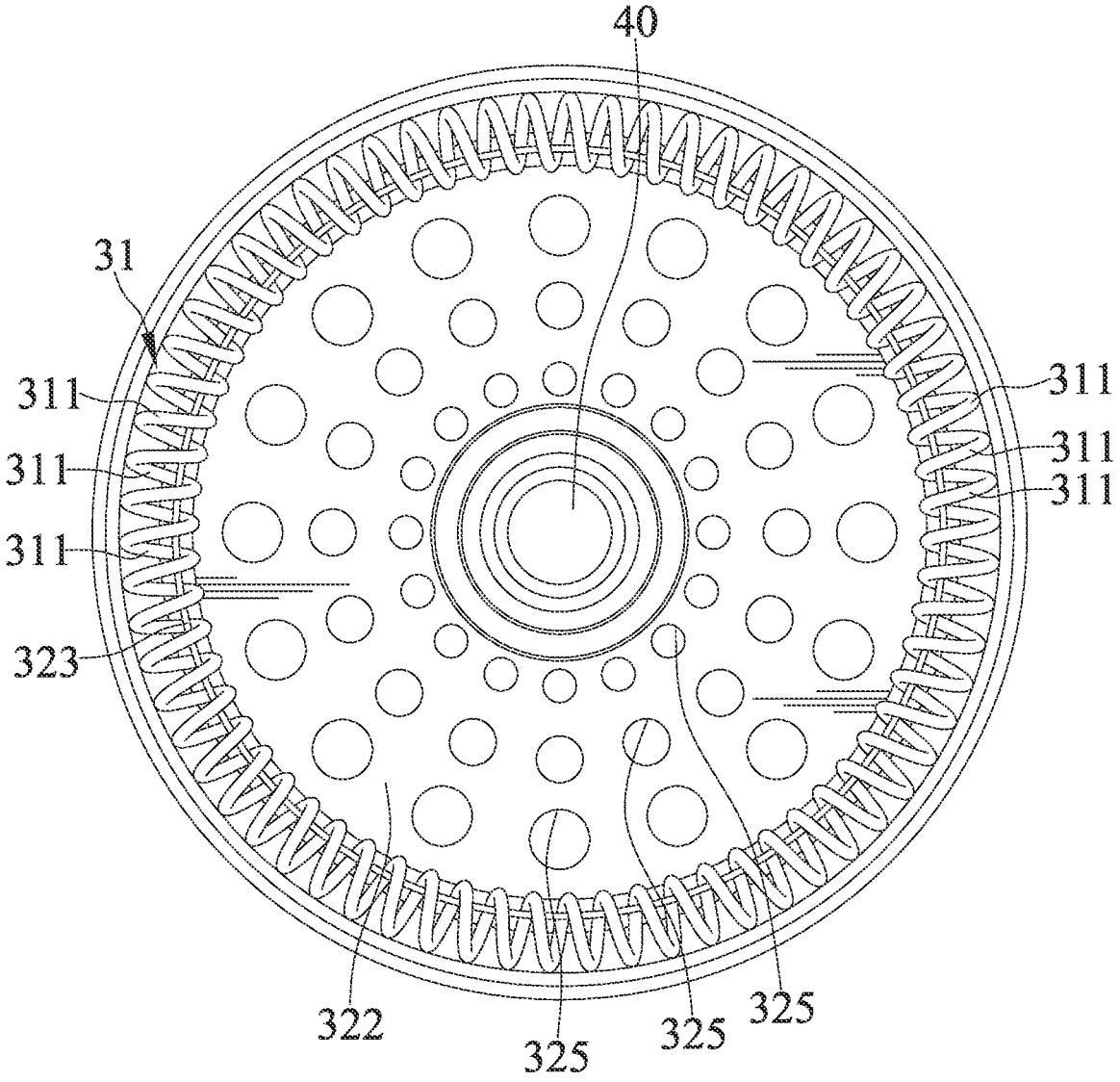
FIG. 3 is a top view of the combustion device of FIG. 1.
Figure 4:
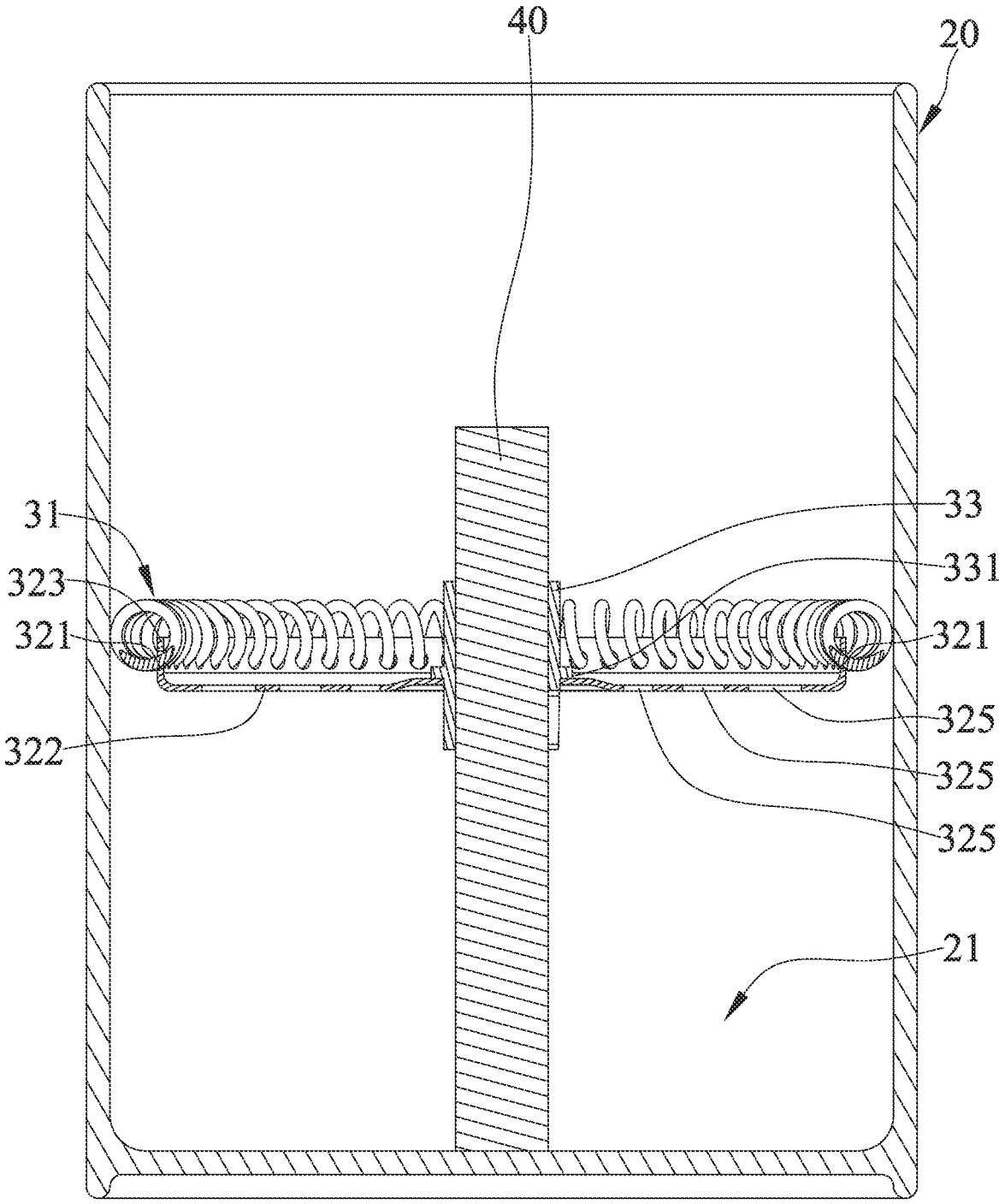
FIG. 4 is a cross-sectional view of the combustion device of FIG. 1.

Refer to FIGS. 1 through 6, a combustion device 10 allowing for an easy wick installation includes a container 20, a wick holder 30, and a wick 40

The container 20 has an opening and a space forming a fuel tank 21 for receiving fuel. The container 20 has an accommodating portion 22 which delimits the fuel tank 21. The container 20 has a guarding portion 23, which is adapted to guard the wick 40 against winds, extending vertically upward from the accommodating portion 22. The accommodating portion 22 is non-transparent. The guarding portion 23 is transparent and therefore can be seen through easily when a user observes a flame produced on the combustion device 10.

The wick holder 30 is mounted in the container 20. The wick holder 30, along an outer peripheral edge thereof, has a resilient structure and defines an elastic portion 31. The wick holder 30 has a main body 32 which includes a plurality of position limiting holes 321 extending therethrough. The main body 32 integrally forms a body portion 322 extending in a horizontal direction and a side wall 323 extending in a vertical direction. The body portion 322 is encircled by the side wall 323 and extends upwardly therefrom in the vertical direction. The side wall 323 extends in a horizontal direction along the body portion 322 and circularly. The plurality of position limiting holes 321 are arranged on the side wall 323. The body portion 322 has a center hole 324 and a plurality of perforations 325. The center hole 324 is in the center of the body portion 322 and the plurality of perforations 325 are distributed around the center hole 324. The elastic portion 31 is resiliently deformable and abuts against an inner peripheral edge of the container 20, thereby fitting in the container 20. The elastic portion 31 is encircled by the inner peripheral edge of the container 20. The elastic portion 31 extends in a horizontal direction along the outer peripheral edge of the wick holder 30. The elastic portion 31 is in a form including a plurality of helical coils 311. The elastic portion 31 abuts against a section of the accommodating portion 22 which is adjacent to the guarding portion 23. The plurality of helical coils 311 are connected to one another in series and arranged one after another annularly.

The wick 40 is insertably mounted on the wick holder 30. The wick 40 has a first end inserted into the fuel tank 21 and a second end protruding on a side of the wick holder 30 opposite to the fuel tank 21. The wick 40 is inserted through the center hole 324 into the fuel tank 21. The wick holder 30 includes a sleeve 33 configured to retain the wick 40 on the body portion 322 and to prevent the body portion 322 from touching the wick 40. The wick 40 includes an outer peripheral edge thereof encircled by the sleeve 33. The sleeve 33 is inserted in the center hole 324 and the body portion 322 is between two opposite ends of the sleeve 33. The sleeve 33 has an outer peripheral edge thereof including a flange 331 protruding therefrom and located between the two opposite ends of the sleeve 33. The flange 331 abuts against a first side of the body portion 322. The flange 331 abuts against a first side of the body portion 322 which is opposite to a second side that is more adjacent to the fuel tank 21 than the first side.

The elastic portion 31 is resiliently deformable and can be compressed radially, and therefore the wick holder 30 can insert through the opening of the container 20 and mounted therein more easily without a process of precisely aligning it with the opening of the container 20. Moreover, the wick holder 30 is resiliently expandable radially, and therefore frictionally engage the container 20 at any height and disposed therein by elastic force.

In view of the foregoing, the wick 40 can stand upright in the combustion device 10 easily and stably through the wick holder 30.

The foregoing is merely illustrative of the principles of this invention and various modifications can be made by those skilled in the art without departing from the scope and spirit of the invention.

What is claimed is:

1. A combustion device allowing for an easy wick installation comprising:

a container having a space forming a fuel tank;

a wick holder mounted in the container, wherein the wick holder, along an outer peripheral edge thereof, has a resilient structure and defines an elastic portion, and wherein the elastic portion is resiliently deformable and abuts against an inner peripheral edge of the container, thereby fitting in the container; and a wick insertably mounted on the wick holder, wherein the wick has a first end inserted into the fuel tank and a second end protruding on a side of the wick holder opposite to the fuel tank, wherein the wick holder has a main body which includes a plurality of position limiting holes extending therethrough, wherein the elastic portion is in a form including a plurality of helical coils and one of the plurality of helical coils respectively inserts through one of the plurality of position limiting holes, and wherein the plurality of helical coils are connected to one another in series and arranged one after another annularly, and wherein the main body integrally forms a body portion extending in a horizontal direction and a side wall extending in a vertical direction, wherein the body portion is encircled by the side wall and extends upwardly therefrom in the vertical direction, and wherein the plurality of position limiting holes are arranged on the side wall.

2. The combustion device as claimed in claim 1, wherein the elastic portion is encircled by the inner peripheral edge of the container.

3. The combustion device as claimed in claim 2, wherein the elastic portion extends in a horizontal direction along the outer peripheral edge of the wick holder.

4. The combustion device as claimed in claim 1, wherein the elastic portion extends in a horizontal direction along the outer peripheral edge of the wick holder.

5. The combustion device as claimed in claim 4, wherein the elastic portion is in a form including a plurality of helical coils, and wherein the plurality of helical coils are connected to one another in series and arranged one after another annularly.

6. The combustion device as claimed in claim 1, wherein the body portion has a center hole and a plurality of perforations, wherein the center hole is in the center of the body portion and the plurality of perforations are distributed around the center hole, and wherein the wick is inserted through the center hole into the fuel tank.

7. The combustion device as claimed in claim 6, wherein the wick holder includes a sleeve configured to retain the wick on the body portion and to prevent the body portion from touching the wick, wherein the wick includes an outer peripheral edge thereof encircled by the sleeve, and wherein the sleeve is inserted in the center hole and the body portion is between two opposite ends of the sleeve.

8. The combustion device as claimed in claim 7, wherein the sleeve has an outer peripheral edge thereof including a flange protruding therefrom and located between the two opposite ends of the sleeve, and wherein the flange abuts against a first side of the body portion.

9. The combustion device as claimed in claim 1, wherein the side wall extends in a vertical direction along the body portion and circularly.

10. The combustion device as claimed in claim 1, wherein the container has an accommodating portion which delimits the fuel tank, wherein the container has a guarding portion, which is adapted to guard the wick against winds, extending vertically upward from the accommodating portion, wherein the accommodating portion is non-transparent, and wherein the guarding portion is transparent.

11. The combustion device as claimed in claim 10, wherein the elastic portion abuts against a section of the accommodating portion which is adjacent to the guarding portion.

* * * * *